US009487728B2

(12) United States Patent
Lundgren

(10) Patent No.: US 9,487,728 B2
(45) Date of Patent: Nov. 8, 2016

(54) FATTY AMINE SALTS AS FRICTION MODIFIERS FOR LUBRICANTS

(71) Applicant: Akzo Nobel Chemicals International B.V., Amhem (NL)

(72) Inventor: Sarah Lundgren, Ljungskile (SE)

(73) Assignee: AKZO NOBEL CHEMICALS INTERNATIONAL B.V., Arnhem (NL)

( * ) Notice: Subject to any disclaimer, the term of this patent is extended or adjusted under 35 U.S.C. 154(b) by 0 days.

(21) Appl. No.: 15/027,476

(22) PCT Filed: Oct. 22, 2014

(86) PCT No.: PCT/EP2014/072586
§ 371 (c)(1),
(2) Date: Apr. 6, 2016

(87) PCT Pub. No.: WO2015/059162
PCT Pub. Date: Apr. 30, 2015

(65) Prior Publication Data

US 2016/0251590 A1 Sep. 1, 2016

(30) Foreign Application Priority Data

Oct. 25, 2013 (EP) ..... 13190319

(51) Int. Cl.
*C07F 5/04* (2006.01)
*C07C 229/00* (2006.01)
*C10M 133/06* (2006.01)

(52) U.S. Cl.
CPC ..... *C10M 133/06* (2013.01); *C10M 2215/04* (2013.01); *C10N 2230/06* (2013.01); *C10N 2230/54* (2013.01); *C10N 2240/10* (2013.01)

(58) Field of Classification Search
CPC ..... C10M 2227/061; C07C 255/00
USPC ..... 508/200; 554/104
See application file for complete search history.

(56) References Cited

U.S. PATENT DOCUMENTS 4,314,907 A 2/1982 Defretin et al.
(Continued)

FOREIGN PATENT DOCUMENTS

| | | |
|---|---|---|
| CA | 1138854 | 1/1983 |
| EP | 2011855 A2 | 1/2009 |
| JP | 07179875 | 7/1995 |
| JP | 2003020492 | 1/2003 |
| WO | 92/13049 A1 | 8/1992 |

OTHER PUBLICATIONS

European Search Report for European Serial No. 13190319.7, date Feb. 13, 2014.
(Continued)

*Primary Examiner* — Vishal Vasisth
(74) *Attorney, Agent, or Firm* — Matthew D. Kellam

(57) ABSTRACT

The present invention relates to the use of a partly neutralized fatty amine salt where the fatty amine is having the formula where R is a hydrocarbyl group having 12-24 carbon atoms; X is H, a C1-C4 alkyl group, benzyl or —$CH_2CH_2CH_2NH_2$, m is 2 or 3 and n is 0-3, provided that when n is 0, then X IS —$CH_2CH_2CH_2NH_2$, and m is 3; and where the acid neutralizing the fatty amine has the formula R'COOH (II), where R'CO is an acyl group having 16-24 carbon atoms; and where the molar ratio between the moles of nitrogen atoms in the fatty amine and the moles of fatty acid is 5:1 to 1.25:1; as a friction modifier for a lubricating oil, especially for an internal combustion engine. The invention also relates to a lubricating oil composition comprising the partly acid neutralized product (I), and to a method for lubrication of interfacing mutually movable surfaces by bringing the surfaces into contact with the said lubricating oil.

(I)

13 Claims, 2 Drawing Sheets

(56) References Cited

U.S. PATENT DOCUMENTS

| | | | | |
|---|---|---|---|---|
| 4,581,039 | A | 4/1986 | Horodysky | |
| 5,174,914 | A | 12/1992 | Gutzmann | |
| 5,536,423 | A | 7/1996 | Miyagawa et al. | |
| 5,549,838 | A | 8/1996 | Miyagawa et al. | |
| 2004/0047830 | A1* | 3/2004 | Goldberg | A61K 8/044 424/73 |
| 2009/0005278 | A1* | 1/2009 | Takeuchi | C10M 141/06 508/371 |

OTHER PUBLICATIONS

International Search Report and Written Opinion for PCT/EP2014/072586, date of mailing Dec. 8, 2014.

* cited by examiner

FATTY AMINE SALTS AS FRICTION MODIFIERS FOR LUBRICANTS

This application is a national stage filing under 35 U.S.C. §371 of PCT/EP2014/072586, filed Oct. 22, 2014, which claims priority to European Patent Application No. 13190319.7, filed Oct. 25, 2013, the contents of which are each incorporated herein by reference in their entireties.

TECHNICAL FIELD OF INVENTION

The present invention relates to the use of fatty amine salts as friction modifiers for lubricating oils, especially for internal combustion engines, and also to a lubricating oil composition comprising these friction modifiers.

TECHNICAL BACKGROUND OF THE INVENTION

Fuel economy is an important feature in engine, fuel and lubricant development. By lowering the friction of the engine, less of the power put into it is lost and more energy is spent on moving the vehicle. Consequently, a vehicle can run for a longer time on the same amount of fuel.

Motor oil is used for the lubrication, cooling, and cleaning of internal combustion engines. Thus, its main function is to help surfaces slide relative to each other preventing wear to the engine. Most motor oils are derived from crude oil, with additives to improve certain properties. The bulk of motor oil typically consists of hydrocarbons with between 18 and 34 carbon atoms. One of the most important properties of motor oil in maintaining a lubricating film between moving parts is its viscosity, which must be high enough to maintain a lubricating film, but low enough that the oil can flow freely to reach the engine parts under all conditions that would most likely be encountered. An important parameter in this connection is the viscosity index, which is a measure of how much the viscosity of the oil changes due to temperature. A higher viscosity index indicates that the viscosity changes less with temperature than a lower viscosity index.

At slow enough speed of the moving parts or low enough viscosity surface asperities come into contact. At this stage the surfaces will only be protected by a very thin film on each surface. One of the additives making this film is the anti-wear additive zinc dialkyl dithiophosphate, ZDDP. ZDDP prevents wear of the metal surfaces by reacting with metal oxides on the metal surface to create a protective metal sulphide film (for most engines the film is iron sulfide). This soft sulphide film protects engine parts by sacrificing itself in lieu of wearing the harder metal surface.

Another type of additives is friction modifiers, which go to the surface to create a film. A common friction modifier is the inorganic molybdenum dithiocarbamate. This friction modifier works by breaking down on the surface to form a layer of molybdenum disulphide sheets. These sheets consist of a plate-like structure containing layers of molybdenum atoms sandwiched between layers of sulphur atoms. Between each adjacent layer of sulphur atoms are weak bonds that allow each plate to slide easily over one another resulting in a low coefficient of friction.

U.S. Pat. No. 4,314,907 relates to oil additive compositions for internal combustion engines containing at least one dithiophosphate, at least one fatty amide and a fluorographite $CF_x$, where x is between 0.6 and 1 and oils containing such compositions. The fatty amide could e.g. be prepared by reaction between alkylene diamines and fatty acid.

U.S. Pat. No. 5,174,914 relates to an aqueous liquid lubricant composition for a chain driven conveyor system, which composition includes fatty acid diamine salts, a hydrotrope for providing sufficient aqueous solubility, an anionic or nonionic surfactant, and a chelating agent.

U.S. Pat. No. 5,549,838 relates to hydraulic working oil compositions for use in buffers comprising a phosphoric acid ester, and/or a phosphorous acid ester, and at least one kind of a nitrogen-containing compound selected from the group consisting of an alkylene oxide adduct of an aliphatic monoamine, an aliphatic polyamine, a salt of the polyamine with an aliphatic acid having 6-22 carbon atoms, and an aliphatic monoamine. The salt is preferably one in which one aliphatic acid per nitrogen atom in the aliphatic polyamine has been reacted with the aliphatic polyamine, to form a salt such as octyl ethylenediamine-dimyristate.

US 2009/0005278 A1 relates to a lubricating oil composition for internal combustion engines comprising a base oil having a lubricating viscosity and additives composed of a) a salt of an alkali metal or alkaline earth metal and an alkylsalicylate and/or alkylcarboxylate, b) a nitrogen atom-containing ashless dispersant and/or a nitrogen atom-containing dispersive viscosity index improver, c) a neutral salt of a fatty acid and a fatty amine, and d) an oxidation inhibitor, which composition is effective for lubricating diesel engines using a low sulfur-content fuel. Preferred compounds c) are exemplified by salts of oleic acid with different fatty monoamines and by a salt of 2 moles oleic acid with one mole N-oleylpropylenediamine.

U.S. Pat. No. 4,581,039 relates to certain hydrocarbyl hydrocarbylenediamine carboxylates, which can be made by the reaction between an appropriate diamine and an organic monocarboxylic acid, and to lubricant and fuel compositions containing the same. The products may be formed from one diamine and one monocarboxylic acid, or from one diamine and two monocarboxylic acids.

However, there is still a need for more effective lubricating oil compositions.

SUMMARY OF THE INVENTION

It is an object of the present invention to provide a product that reduces friction of lubricating oils, thereby improving fuel economy.

Now it has surprisingly been found that a partly neutralised fatty amine salt works as an excellent friction modifier for a lubricating oil to be used in, for example, an internal combustion engine or a gearbox.

DETAILED DESCRIPTION OF THE INVENTION

Figure 1:
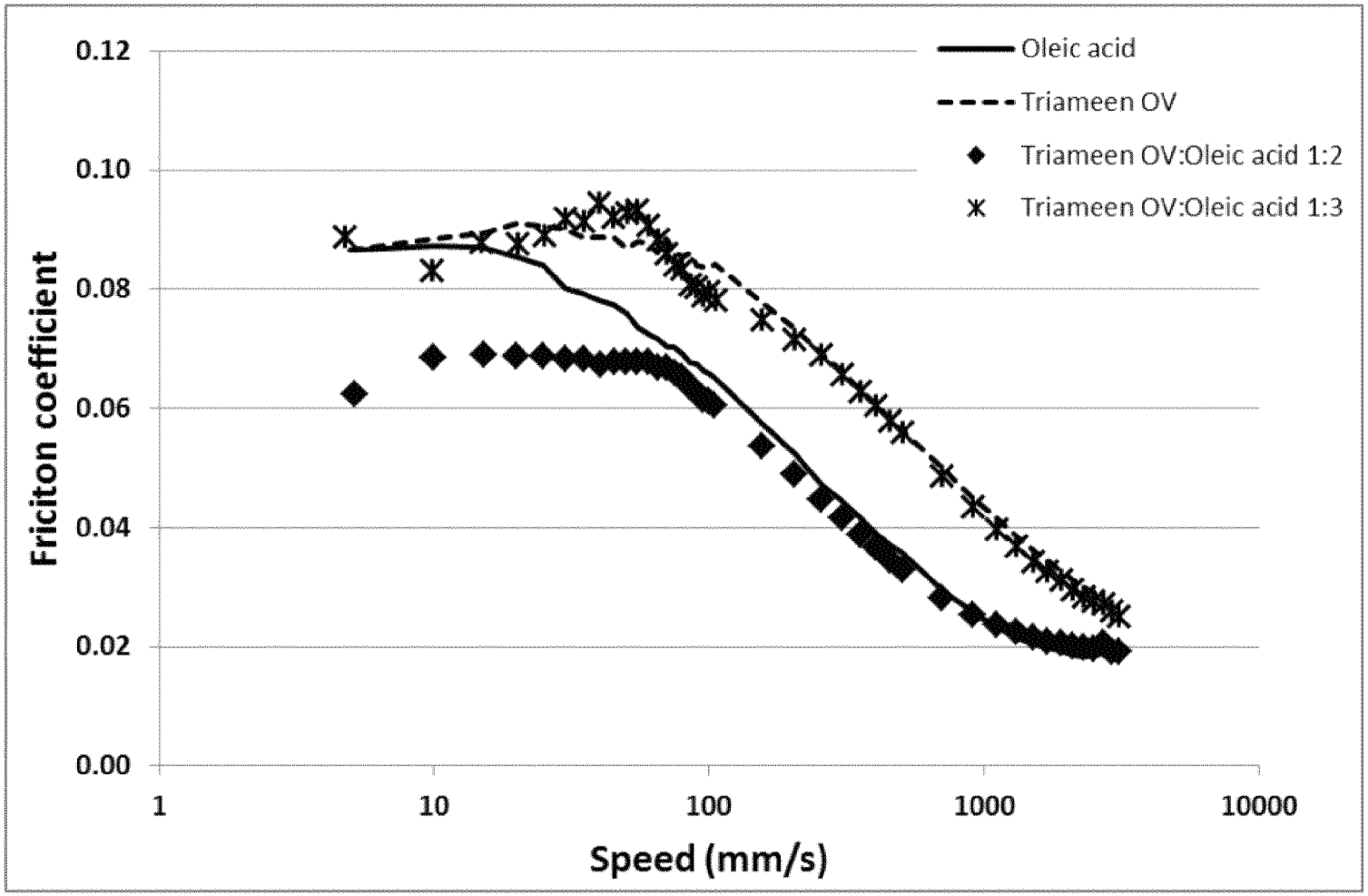
FIG. 1 plots the results from example 1.

A first aspect of the present invention relates to the use of a partly neutralised fatty amine salt where the fatty amine is having the formula

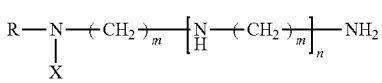

(I)

where R is a hydrocarbyl group having 12-24, preferably 14-24, more preferably 16-24, and most preferably 18-24 carbon atoms; X is H, a C1-C4 alkyl group, preferably a methyl group, benzyl or —$CH_2CH_2CH_2NH_2$, m is 2 or 3, preferably 3, and n is 0-3, preferably 0-2, and most preferably 0-1, provided that when n is 0, then X is —$CH_2CH_2CH_2NH_2$ and m is 3; and where the acid neutralising the fatty amine has the formula R'COOH (II), where R'CO is an acyl group having 16-24 carbon atoms; and where the molar ratio between the moles of nitrogen atoms in the fatty amine and the moles of fatty acid is 5:1 to 1.25:1, preferably 2.5:1 to 1.5:1;

as a friction modifier for a lubricating oil, especially for an internal combustion engine.

Thus, on average between 20% and 80% of the nitrogen atoms present in the molecule should be neutralised.

The groups R and R' in formula (I) and (II) could independently be saturated or unsaturated, preferably unsaturated, or linear or branched. Suitably the groups R and R' would be derived from fatty acids of natural origin, and thus normally be linear.

A second aspect of the present invention relates to a lubricating oil composition comprising the partly acid neutralised product (I).

A third aspect of the present invention relates to a method for lubrication of interfacing mutually movable surfaces by bringing the surfaces into contact with a lubricating oil composition as described above. Preferably the surfaces are parts of an internal combustion engine or a gearbox.

In one embodiment the fatty amine has the formula

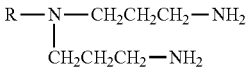

and the acid is oleic acid.

In a second embodiment the fatty amine has the formula

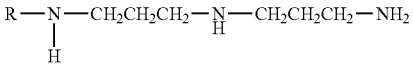

and the acid is soya fatty acid

In a third embodiment the fatty amine has the formula

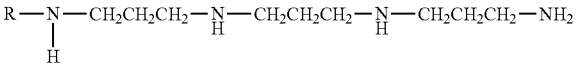

and the acid is erucic acid.

The above-mentioned products (I) are made by processes well-known in the art, such as described in "Aliphatic Amines", part 7, by Karsten Eller, Erhard Henkes, Roland Rossbacher, and Harmut Höke in *Ullmann's Encyclopedia of Industrial Chemistry*, published online 15 Jun. 2000.

Suitable fatty amines are N,N-bis(3-aminopropyl)(rape seed alkyl)amine, N,N-bis(3-aminopropyl)(tallow alkyl)amine, N,N-bis(3-aminopropyl)(soya alkyl)amine, N,N-bis(3-aminopropyl)oleylamine, N,N-bis(3-aminopropyl) erucylamine, N-oleyl-N'-(3-aminopropyl)-1,3-propanediamine, N-(tallow alkyl)-N'-(3-aminopropyl)-1,3-propanediamine, N-(rape seed alkyl)-N'-(3-aminopropyl)-1,3-propanediamine, N-(soya alkyl)-N'-(3-aminopropyl)-1,3-propanediamine, N-erucyl-N'-(3-aminopropyl)-1,3-propanediamine, N-(3-aminopropyl)-N'-[3-(erucylamino)propyl]-1,3-propanediamine, N-(3-aminopropyl)-N'-[3-(9-octadecenylamino)propyl]-1,3-propanediamine and N-(3-aminopropyl)-N'-[3-(rape seed alkylamino)propyl]-1,3-propanediamine.

Suitable fatty acids are rape seed fatty acid, soya fatty acid, tallow fatty acid, oleic acid and erucic acid.

The lubricating oil composition preferably comprises a) a base oil belonging to Group I-V according to the categorization API 1509, Appendix E; and b) 0.05-5% by weight, based on the total weight of the composition, of the amine salt between the fatty amine having formula (I) and a carboxylic acid having formula (II).

The American Petroleum Institute (API) has categorized base oils into five categories (API 1509, Appendix E). The first three groups are refined from petroleum crude oil, group IV base oils are full synthetic (polyalphaolefin) oils, and group V is for all other base oils not included in Groups I through IV. Important parameters are amount of sulphur, amount of saturates (mostly paraffins) and viscosity index. Base oils in all of the categories Group I-V may be used in the present invention, but most preferred are the ones belonging to Group II-IV.

The composition preferably comprises at least 70, more preferably at least 75, and most preferably at least 80% by weight, based on the total weight of the composition, of the base oil.

The composition may further contain minor amounts of other additives, for example viscosity index improvers such as olefin copolymers, polyisobutylenes, polymethacrylates; detergents such as sulfonates, salicylates and phenates; dispersants such as polyisobutylene succinimides; anti-wear additives, such as zinc dialkyldithiophosphates; other friction modifiers such as molybdenum dithiocarbamide and fatty acid esters; corrosion inhibitors such as imidazolines; as conventionally used in lubricating oil. The concentration of these additives is typically 20-25% by weight of the total lubricating oil composition.

The composition may further contain minor amounts of water, preferably at most 1% by weight, but most preferably it is essentially free from water.

The present invention is further illustrated by the following examples.

EXAMPLES

Example 1

Preparation of Triameen OV:Oleic Acid 1:2

13.11 gram of Triameen OV (oleyl dipropylentriamine; ex Akzo Nobel) was blended with 19.99 gram of RADIACID 0213 (oleic acid; ex Oleon) and the blend was heated to 60° C. under stirring. The sample was kept at 60° C. for 30 minutes. The molar ratio of fatty amine to oleic acid was 1:2, which means that the molar ratio between the moles of nitrogen in the amine and the fatty acid was 1.5:1.

Preparation of Triameen OV:Oleic Acid 1:3 (Comparison)

10.71 gram of oleyl dipropylentriamine was blended with 20.02 gram of RADIACID 0213 (oleic acid; ex Oleon) and the blend was heated to 60° C. under stirring. The sample was kept at 60° C. for 30 minutes. The molar ratio of fatty amine to oleic acid was 1:3, which means that the molar ratio between the moles of nitrogen in the amine and the fatty acid was 1:1.

Friction Testing

The friction performance of the products was tested in a minitraction machine (MTM2) from PCS Instruments. These specimens and rig were cleaned according to manual. In the test profile, a load of 20N was used and the temperature was 100° C. First a Stribeck curve was run where the speed was ramped from 5 mm/s to 3105 mm/s and then the friction was measured with constant speed (100 mm/s) for 2 hours. Then one more Stribeck curve was run and in FIG. 1 this last Stribeck curve is shown. All four friction modifiers in the graph have been tested in combination with 0.5% by weight of an anti-wear additive, T205 Zinc Propyl Octyl Primary-Secondary Dialkyl Dithiophosphate (ex Tianhe Chemicals™). The concentration of the friction modifiers are 0.5% by weight. The base oil used was a group III base oil. The new products are compared to the components used to make the product. Triameen OV:Oleic acid 1:3 is similar to the triamine used to make it while Triameen OV:Oleic acid 1:2 lowered the friction compared to the components used to make it and lowered the friction compared to Triameen OV:Oleic acid 1:3.

Example 2

Preparation of Triameen YT:Oleic Acid 1:1

30 gram of Triameen YT (tallow alkyl dipropylentriamine; ex Akzo Nobel) was blended with 20 gram of RADIACID 0213 (oleic acid; ex Oleon) and the blend was heated to 60° C. under stirring. The sample was kept at 60° C. for 30 minutes. The molar ratio of fatty amine to oleic acid was 1:1, which means that the molar ratio between the moles of nitrogen in the amine and the fatty acid was 3:1.

Preparation of Triameen YT:Oleic Acid 1:2

654 gram of Triameen YT (tallow alkyl dipropylentriamine; ex Akzo Nobel) was blended with 968 gram of RADIACID 0213 (oleic acid; ex Oleon) and the blend was heated to 60° C. under stirring. The sample was kept at 60° C. for 30 minutes. The molar ratio of fatty amine to oleic acid was 1:2, which means that the molar ratio between the moles of nitrogen in the amine and the fatty acid was 1.5:1.

Preparation of Triameen YT:Oleic Acid 1:3 (Comparison)

10 gram of Triameen YT (tallow alkyl dipropylentriamine; ex Akzo Nobel) was blended with 20 gram of RADIACID 0213 (oleic acid; ex Oleon) and the blend was heated to 60° C. under stirring. The sample was kept at 60° C. for 30 minutes. The molar ratio of fatty amine to oleic acid was 1:3, which means that the molar ratio between the moles of nitrogen in the amine and the fatty acid was 1:1.

Figure 2:
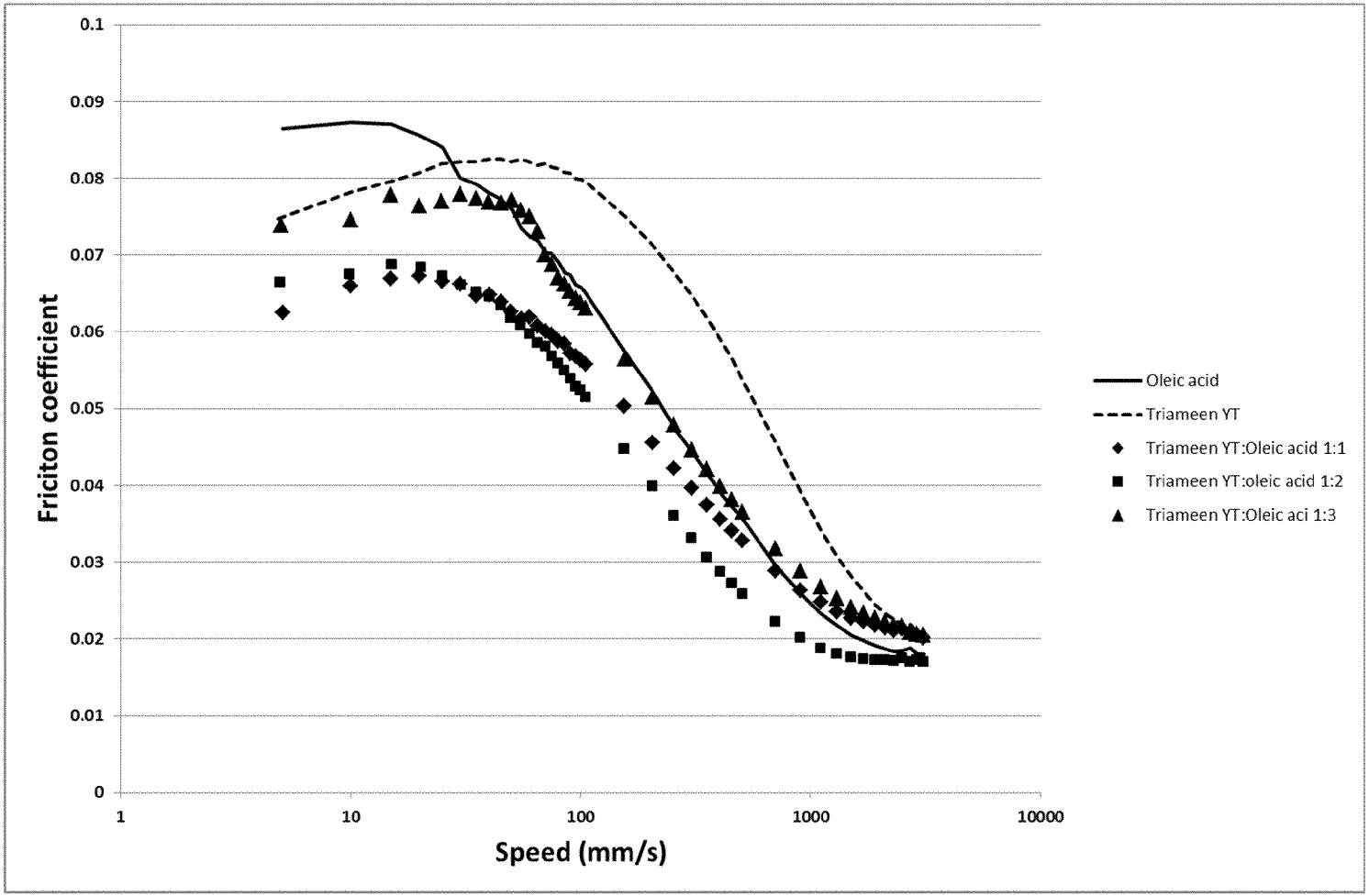
FIG. 2 plots the results from example 2.

The friction performance of the products was tested in a minitraction machine (MTM2) from PCS Instruments. These specimens and rig was cleaned according to manual. In the test profile, a load of 20N was used and the temperature was 100° C. First a Stribeck curve was run where the speed was ramped from 5 mm/s to 3105 mm/s and then the friction was measured with constant speed (100 mm/s) for 2 hours. Then one more Stribeck curve was run and in FIG. 2 this last Stribeck curve is shown. All four friction modifiers in the graph have been tested in combination with 0.5 weight percent of an anti-wear additive, T205 Zinc Propyl Octyl Primary-Secondary Dialkyl Dithiophosphate (ex Tianhe Chemicals TM). The concentration of the friction modifiers are 0.5 weight percent. The base oil used was a group III base oil. The new products are compared to the components used to make the product. Triameen YT:Oleic acid 1:3 has a friction similar to oleic acid in the mixed lubrication region and similar to Triameen YT in the boundary lubrication region. Triameen YT that is partially neutralized, 1:1 and 1:2, lowered the friction better than the fully neutralized sample, 1:3. 1:1 and 1:2 are similar in boundary and 1:1 is best in mixed lubrication region.

The invention claimed is:

1. A method of modifying the friction of a lubricating oil with a partly neutralised fatty amine salt where the fatty amine is having the formula

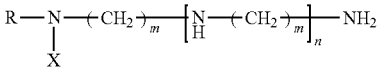

(I)

where R is a hydrocarbyl group having 12-24; X is H, a C1-C4 alkyl group, preferably; m is 2 or 3, and n is 0-3, provided that when n is 0, then X is —$CH_2CH_2CH_2NH_2$, and m is 3; and where the acid neutralising the fatty amine has the formula R'COOH (II), where R'CO is an acyl group having 16-24 carbon atoms; and where the molar ratio between the moles of nitrogen atoms in the fatty amine and the moles of fatty acid is 5:1 to 1.25:1.

2. The method of claim 1 wherein the lubricating oil is an internal combustion engine or a gearbox lubricating oil.

3. The method of claim 1 wherein m is 3, X is —$CH_2CH_2CH_2NH_2$ and n is 0, and the fatty acid is oleic acid.

4. The method of claim 1 wherein m is 3 and n is 1 and the fatty acid is oleic acid.

5. A lubricating oil composition comprising 0.05-5% by weight, based on the total weight of the composition, of the partly neutralized fatty amine salt as defined in claim 1.

6. A composition according to claim 5 comprising a) a base oil belonging to Group I-V according to the categorization API 1509, Appendix E b) 0.05-5% by weight, based on the total weight of the composition, of the partly neutralized amine salt between the fatty amine having formula (I) and a carboxylic acid having formula (II) as defined in claim 1.

7. A composition according to claim 6 wherein the molar ratio between the moles of nitrogen atoms in the fatty amine (I) and the moles of fatty acid (II) is 2.5:1 to 1.5:1.

8. A composition according to claim 7 further comprising a corrosion inhibitor, an anti-wear additive and a viscosity index improver.

9. A composition according to claim 6, comprising at least 70, by weight, based on the total weight of the composition, of said base oil.

10. A composition according to claim 6, comprising at most 1% by weight, based on the total weight of the composition, of water.

11. A method for lubrication of interfacing mutually movable surfaces by bringing the surfaces into contact with a lubricating oil composition as described in claim 5.

12. A method according to claim 11 where the surfaces are parts of an internal combustion engine or a gearbox.

13. The method of claim 1 wherein X is chosen form the group consisting of a methyl group, benzyl or —$CH_2CH_2CH_2NH_2$.

* * * * *